US007178291B2

(12) United States Patent
Vasquez

(10) Patent No.: US 7,178,291 B2
(45) Date of Patent: Feb. 20, 2007

(54) AUTOMATED SHUTTER CONTROL

(76) Inventor: Jeffrey Frank Vasquez, 144 Calle del Prado, Thousand Oaks, CA (US) 91320

( * ) Notice: Subject to any disclaimer, the term of this patent is extended or adjusted under 35 U.S.C. 154(b) by 0 days.

(21) Appl. No.: 10/786,770

(22) Filed: Feb. 25, 2004

(65) Prior Publication Data

US 2005/0183833 A1 Aug. 25, 2005

(51) Int. Cl.
*E06B 7/096* (2006.01)
*E06B 7/08* (2006.01)

(52) U.S. Cl. ..... 49/82.1; 49/80.1; 49/74.1; 52/473

(58) Field of Classification Search ..... 49/82.1, 49/87.1, 80.1, 90.1, 73.1, 74.1, 403; 52/473; 454/277, 278, 280, 281, 304
See application file for complete search history.

(56) References Cited

U.S. PATENT DOCUMENTS

| | | | | | |
|---|---|---|---|---|---|
| 21,732 | A | | 10/1858 | Babcock | |
| 2,952,049 | A | | 9/1960 | Vetere | |
| 3,177,367 | A | * | 4/1965 | Brown | 49/25 |
| 3,991,518 | A | * | 11/1976 | Ishihara | 49/74.1 |
| 4,254,581 | A | * | 3/1981 | Ishihara | 49/82.1 |
| 4,279,240 | A | * | 7/1981 | Artusy | 49/25 |
| 4,427,048 | A | | 1/1984 | Osaka | |
| 4,449,563 | A | * | 5/1984 | Toda et al. | 49/74.1 |
| 5,379,551 | A | | 1/1995 | Swapp | |
| 5,413,161 | A | | 5/1995 | Corazzini | |
| 5,467,556 | A | * | 11/1995 | Lin | 49/82.1 |
| 5,469,658 | A | | 11/1995 | Digianni | |
| 5,600,920 | A | | 2/1997 | Roy | |
| 5,760,558 | A | | 6/1998 | Popat | |
| 6,014,839 | A | | 1/2000 | Ruggles | |
| 6,065,524 | A | * | 5/2000 | Rossini | 160/107 |
| 6,131,335 | A | * | 10/2000 | Lutz | 49/74.1 |
| 6,145,251 | A | | 11/2000 | Ricci | |
| 6,369,530 | B2 | | 4/2002 | Kovach | |
| 6,568,131 | B1 | | 5/2003 | Milano | |
| 6,651,724 | B1 | * | 11/2003 | Cittadini | 160/207 |
| 6,675,534 | B2 | * | 1/2004 | Marocco | 49/86.1 |
| 6,692,349 | B1 | * | 2/2004 | Brinkerhoff et al. | 454/256 |
| 6,854,211 | B1 | * | 2/2005 | Blachley | 49/82.1 |
| 6,910,516 | B2 | * | 6/2005 | Huang | 160/170 |
| 2002/0129553 | A1 | | 9/2002 | Metzed | |

* cited by examiner

*Primary Examiner*—Hugh B. Thompson, II
(74) *Attorney, Agent, or Firm*—Colin P. Abrahams

(57) ABSTRACT

An automated shutter control for a shutter having a plurality of slats which are pivoted in unison, the automated shutter control comprises a motor, a slat interface having a body portion and a connector portion, the connector portion having a contour configured to register with and connect to at least a portion of an end of one of the slats of the shutter, and a moving assembly moved by the motor and connectable to the slat interface so as to move the slat interface between a first and a second position.

32 Claims, 5 Drawing Sheets

AUTOMATED SHUTTER CONTROL

FIELD AND BACKGROUND OF THE INVENTION

This invention relates to an automated shutter control device. Particularly, the invention is directed towards a mechanism for opening and closing shutters associated with a window, door or other type of opening, commonly found in a residential or commercial setting.

Shutters are well known and widely used devices for typically placing within or over a window, and which are moveable between an open and a closed position. In the open position, the shutter device allows light and viewing through the shutter and associated window, while in the closed position, very little light can pass therethrough, and viewing through the window is no longer possible.

A conventional shutter comprises a plurality of adjacent slats generally arranged in a horizontal orientation. Each slat comprises an elongate, flat component, the length of which is determined according to the size of the window or opening which it will cover. The width of a slat will characteristically vary between about 1 inch and 3 inches, although this may of course change. In most shutter arrangements, all of the slats are attached to a single, usually vertical, shaft, and by moving the shaft in a vertical axis, all of the slats are caused, in unison, to pivot about their mounting axes. Thus, when the shaft is moved vertically, all of the slats will, in unison, move to an open position wherein each slat becomes approximately oriented in a horizontal plane. By moving the shaft in the opposite vertical direction, all of the slats will be moved about their pivot axis so as to approach the vertical plane. When in the horizontal plane, an open space is created between each of the adjacent slats to facilitate the passage of light, and this enables a person to look through the shutter. When oriented in the vertical, or substantially vertical plane, the slats essentially close off most light and viewing, since the space between each slat is just slightly less than the width of each slat so that each slat slightly overlaps its adjacent slats to close the shutter.

In many instances, the shutters themselves will be mounted within a frame, or frames, within a window opening. The shutters themselves may be constructed from wood, plastic, metal, fabric or other suitable material, including a combination of such materials.

It will, of course, be appreciated, that the slats can be oriented in any desired or predetermined position between the substantially vertical and horizontal planes, as may be selected by the user.

Different mechanisms for opening and closing the slats of a shutter device are shown in the patent literature. U.S. Pat. No. 5,469,658 (Digianni) shows a shutter device including a rack-and-gear mechanism to open and close the plurality of slats. U.S. Pat. No. 6,014,839 (Ruggles) provides for an actuating assembly including a "tongue" which engages a groove in a slat. U.S. Pat. No. 6,568,121 (Milano) shows a motorized shutter assembly which, in one form, shows a series of enmeshed gears to define a mechanism for engaging the slats.

U.S. Patent Application No. US2002/0129553 (Masan) shows a louver system with a drive arrangement in one of the frame members which includes a plurality of gears mounted on a sub-frame and connected to respective louver blades. U.S. Pat. No. 5,600,920 (Roy) shows a motorized louver structure wherein a blind is formed between two window panes, and a mechanism for opening and closing the blind in provided. U.S. Pat. No. 5,379,551 (Swamp) shows a window shutter where louvers pivot on molded pins which may be provided with individual gears engageable with an elongate rack for synchronized movement. U.S. Pat. No. 5,760,558 (Pophat) describes a solar-powered, wireless, control system for Venetian blinds that generally does not relate to shutters.

Other patents of related subject matter include U.S. Pat. No. 4,427,048 (Osaka); U.S. Pat. No. 6,145,251 (Ricci); U.S. Pat. No. 2,952,049 (Vetere); U.S. Pat. No. 6,369,530 (Kovach); U.S. Pat. No. 5,413,151 (Corazzini); and U.S. Pat. No. 21,732 (Babcock).

SUMMARY OF THE INVENTION

In one aspect of the invention, there is provided an automated shutter control which, when used in association with a shutter device, opens and closes the shutter device in response to actuation, which may be through a switch or a transmitter mechanism.

In one preferred embodiment of the invention, the automated shutter control comprises a motor, a slat connector piece, and an intermediate component between the motor and slat interface, connected to both the motor and the slat interface, which, in response to the appropriate actuation, causes the slat to move between a first and second position. The first position may be that in which the slats to which the slat interfaces are connected are moved into the substantially vertical plane for a closed shutter position. In the second position, the slats may be moved to a substantially horizontal plane, wherein the shutter is in an open position. Of course, the slat interface components may be programmed to stop in any intermediate position between the substantially vertical and horizontal planes, so that the shutter will be in a partial open or closed position, in order that the user may select the appropriate amount of light and viewing which is permitted through the shutter.

In one embodiment, the automated shutter control of the invention is used with a shutter comprising a plurality of horizontally arranged slats formed within a generally square or rectangular frame. Preferably, the motor is mounted on the frame, and may be powered by a power source which is charged by solar energy. Thus, the automated shutter control of the invention may include solar collectors arranged on the exterior or outside-facing part of the frame, and may be adjacent to or housed with the motor.

Furthermore, the invention may also include a transmitter-receiver mechanism whereby the motor may be actuated to open and close the shutters remotely. It will often happen that the shutters are arranged in a window or other opening which may not be easily or conveniently accessible. Therefore, instead of the user having to navigate a path towards the window, a remote control unit may be provided which, in association with the motor and transmitter-receiver device, actuates the motor to place the slats of the shutter in any desired position selected by the user.

According to one aspect of the invention, there is provided an automated shutter control for a shutter having a plurality of slats which are pivoted in unison, the automated shutter control comprising: a motor; a slat interface having a body portion and a connector portion, the connector portion having a contour configured to register with and connect to at least a portion of an end of one of the slats of the shutter; and a moving assembly moved by the motor and connectable to the slat interface so as to move the slat interface between a first and a second position.

Preferably, the body portion includes an elongate slot and the moving assembly includes an engagement pin, the engagement pin being received within the elongate slot. In one form, the moving assembly comprises a screw threaded shaft connected to the motor and rotated about its axis by the motor, and a carriage assembly threadedly mounted on the jack screw so that rotation of the jack screw moves the carriage assembly in a reciprocating linear manner along the jack screw, the direction of movement of the carriage assembly being determined by the direction of rotation of the jack screw. Other forms of body portion and moving assembly arrangements are possible within the scope of the invention. These include, but are not limited to, ball joint confections, a telescoping arm, use of a clevis pin or joint and the like, to name a few alternatives.

Preferably, adhesive means in the form of a double sided tape or glue are provided on the connector portion for providing adhesion to a slat when the slat interface is connected to a slat.

The automated shutter control may further comprise a power source for the motor. This may be a solar energy collector and a solar energy storage device. Preferably, there is a housing for the motor and at least a part of the moving assembly, and the solar collector is mounted on the outside of the housing for exposure to sunlight.

The automated shutter control may include a remote activation system for activating the motor from a distance. The remote activation system may comprise a signal-receiver associated with the automated shutter control, a switch member for activating the motor in response to a signal received from the receiver, and a remote transmitter for transmitting a signal to the signal receiver to activate the motor.

According to another aspect of the invention, there is provided a shutter and automated shutter control combination comprising: a shutter having a plurality of parallel slats which are pivoted in unison; an automated shutter control adjacent the plurality of slats, the automated shutter control comprising a housing, a motor within the housing, a slat interface having a body portion and a connector portion, the connector portion having a contour configured to register with and connect to at least a portion of an end of one of the slats of the shutter, and a moving assembly partially in the housing and partially extending outside of the housing to releasably connect to the slat interface so as to move the slat interface between a first and a second position.

According to yet another aspect of the invention, there is provided a method for opening and closing a shutter having a plurality of slats comprising: attaching a slat interface contoured to register with and engage at least a portion of an end of one of the slats of the shutter; locating a moving assembly adjacent the slat interface so as to engage therewith, the moving assembly not being directly connected to the slats; and reciprocating the moving assembly so that the slat interface moves between a first and a second position corresponding to the open and closed position of the shutter.

DETAILED DESCRIPTION OF THE DRAWINGS

Figure 1:
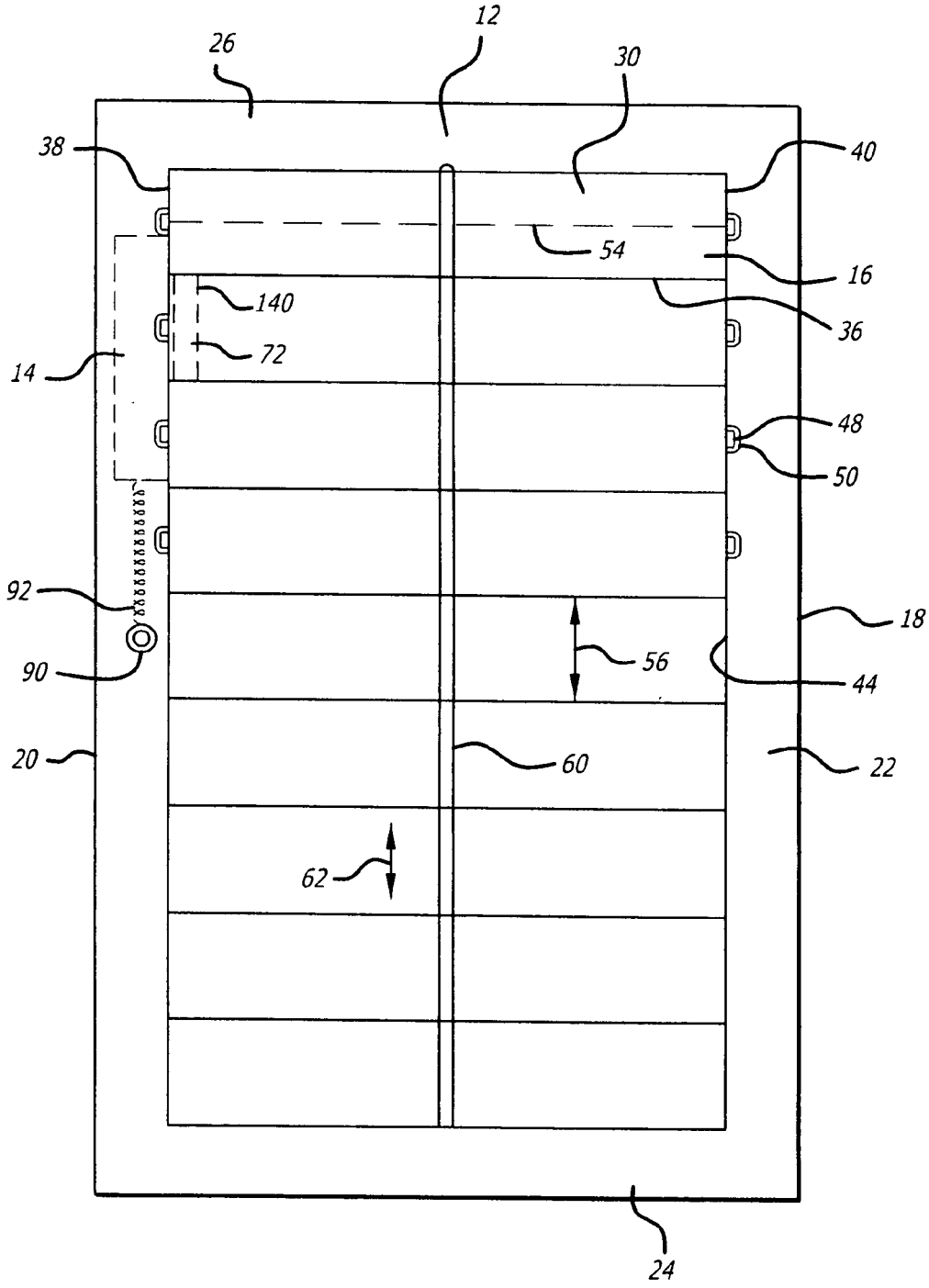
FIG. 1 is a front view of a shutter for use in an opening such as a window, with most of the components of the automated shutter control of the invention shown in phantom lines.

The invention is for an automated shutter control for use on a shutter which typically covers windows or other openings in residential and commercial structures. The automated shutter control of the invention facilitates the automatic opening and closing of the shutter, wherein the slats of a shutter move between a substantially horizontal plane, a substantially vertical plane, or a selected position therebetween.

One advantage of the automated shutter control of the invention is that it may constitute a factory installed accessory on a shutter device, so that when the shutter is initially mounted within the opening, the automated shutter control already forms a part thereof. However, the automated shutter control of the invention may also be added on to existing shutters, either installed or to be installed in an opening, making the shutter control of the invention of substantially universal utility. Generally, in a preferred embodiment of the invention, the automated shutter control does not require any special configuration, amendments or modification to be made to an existing shutter structure, but is designed to fit thereon as a separate entity, having a format which allows it to be attached to an existing shutter in its initially constructed form.

The automated shutter control of the invention will now be described with reference to the accompanying drawings. In the drawings, FIG. 1 generally shows a front view of a shutter assembly with most components of the automated shutter control shown in phantom. From FIG. 1, it will be appreciated that the automated shutter control of the invention can be an effective and compact device which is generally out of view, and does not negatively impact the aesthetic features of the shutter itself. Often, the shutters are made of high quality wood, and can be expensive accessories within a house, and the automated shutter control of the invention acknowledges this in that its design allows it to be substantially small in size and hidden from ordinary viewing.

Figure 2:
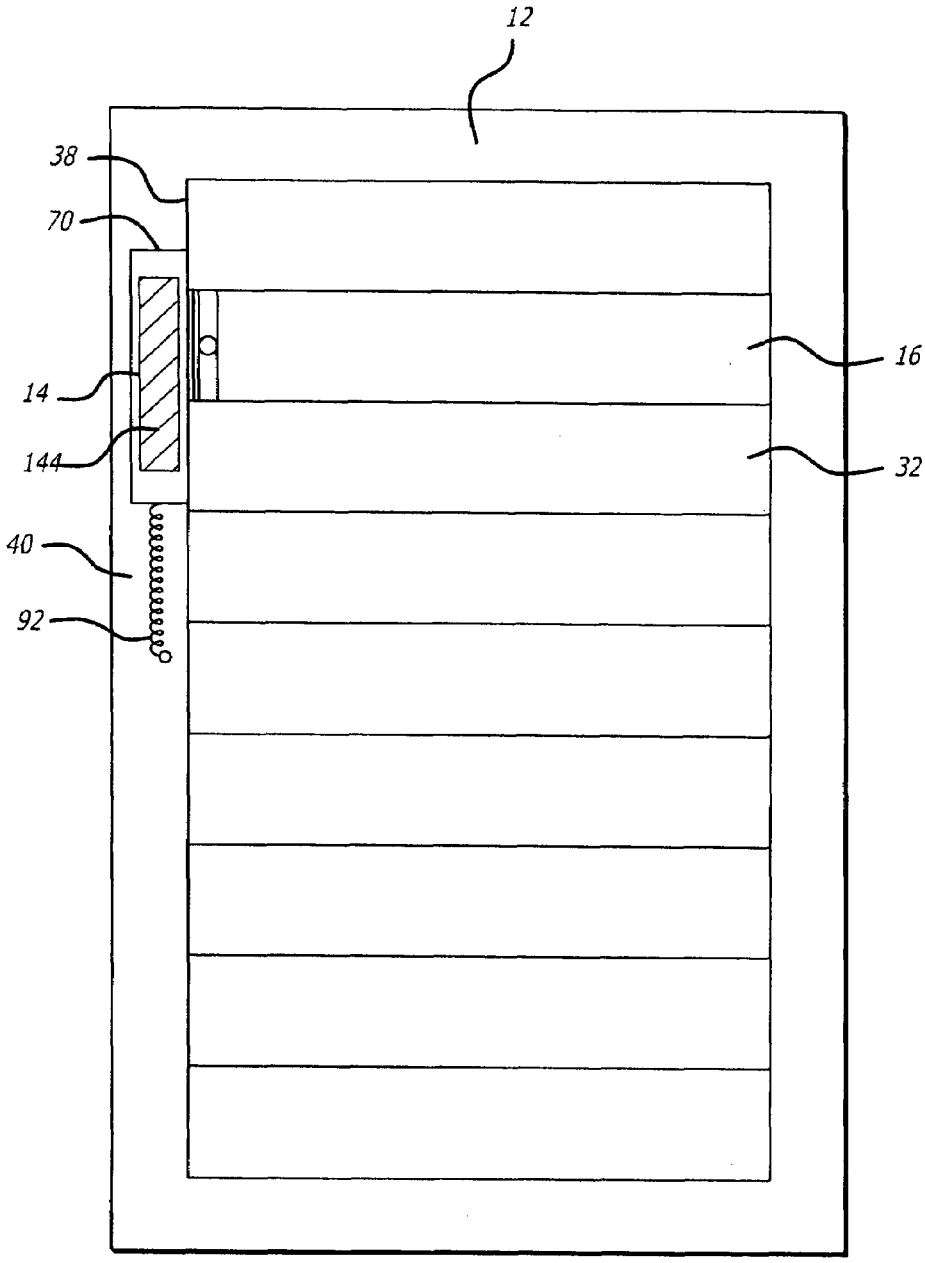
FIG. 2 is a rear view of a shutter shown in FIG. 1 and showing the automated shutter assembly of the invention mounted thereon.

FIG. 2 of the drawings shows a rear view of a shutter assembly 12, to which is attached an automated shutter control 14. The shutter assembly comprises a plurality of horizontally oriented slats 16, mounted within a frame 18. The frame 18 is generally rectangular in shape, having a pair of long sides 20 and 22, and a pair of short sides 24 and 26. It will, of course, be appreciated that the particular shape of the frame 18 in FIGS. 1 and 2 of the drawings is exemplary only, and a very large variety of frame shapes can be configured. The shape will be based upon the dimensions of the opening in which the shutter assembly 12 is to be installed.

Each slat 16 has an inside surface 30, an outside surface 32 (see FIG. 2), a top end 34, and a bottom end 36. Further, each slat 16 has a pair of side edges 38 and 40. The width of each slat 16 is such that it will snugly and comfortably fit within the frame 18, with each of the side edges 38 and 40 being in close proximity with the inner surface 44 of the long sides 20 and 22 respectively.

Each slat 16 has on each of its side edges 38 and 40 a projecting pin 48, and the inner surface 44 of the long sides 20 and 22 each have a corresponding recess 50 for receiving the pin 48. Thus, each slat 16 will be fixed within the confines of the frame 18, but will generally be pivotable about an axis 54 defined by the pins 48 on each side edge 38 and 40 thereof, so that the slat 16 can rotate about a position in the substantially vertical plane, as shown in FIGS. 1 and 2 of the drawings, and a substantially horizontal plane.

It will be noted that the height, or depth, as indicated by arrow 56, of each slat 16, will be just slightly greater than the distance between the vertically arranged pins 48 on each of the side edges 38 and 40 respectively. Thus, when the slats 16 are moved to the substantially vertical position, there will be a slight overlap between adjacent slats 16 to effectively provide a closed condition.

A vertical shaft 60 is provided approximately midway between the side edges 38 and 40, and connected to each of the slats 16. By moving the shaft 60 up and down in the direction of arrow 62, the effect will be to move all of the slats 16 in unison, between the vertical, closed condition, and an open or partially open condition whereby a space for light and viewing will be provided between adjacent slats 16. This shaft 60 comprises the conventional mechanism whereby the slats 16 within a shutter assembly 12 can be opened or closed.

An automated shutter control 14 of the invention is provided for automatically moving the slats 16 between the open, or partially open, and closed condition. The location of the automated shutter control 14 of the invention can be clearly seen, in one embodiment of the invention, with respect to the shutter assembly 12 in FIG. 2 of the drawings. It will, of course, be appreciated that FIG. 1 of the drawings shows the shutter assembly 12 as it will appear from inside of the structure, such as a house, while FIG. 2 provides rear view, which is the view seen when looking from the outside of the structure, through the window to the inside.

The automated shutter control 14 generally comprises a housing 70, which in the embodiment shown in FIG. 2 of the drawings is attached to the side edge 38 of the frame 18, so as to face the outside of the structure, and generally be invisible or hidden from the inside. The automated shutter further comprises a slat interface 72, configured to attach to most conventional types of slats 16 of shutter assemblies 12. The slat interface 72 is generally connected to the housing 70, as will be described below, in such a manner that it can be moved between various positions, in turn moving the slats 16 between the open and closed positions.

Figure 5:
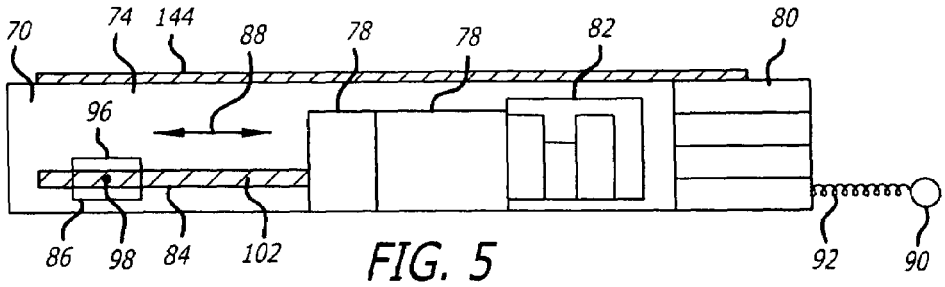
FIG. 5 is a side view of one embodiment of an automated shutter assembly of the invention.
Figure 6:
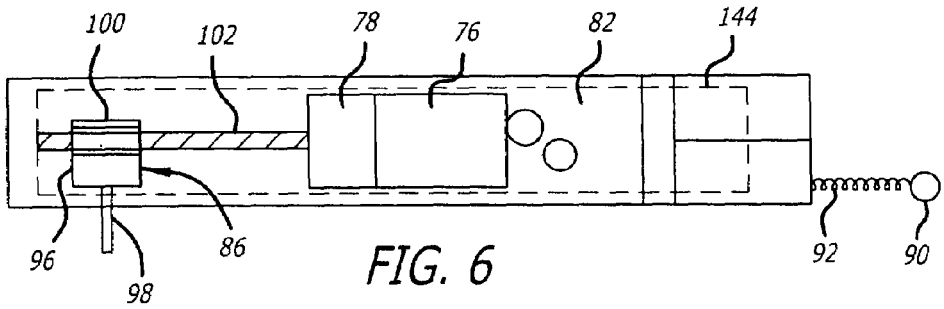
FIG. 6 is a top view of the automated shutter assembly shown in FIG. 5 of the drawings.

Referring more specifically to FIGS. 5 and 6 of the drawings, the housing 70 defines a chamber 74 of elongate dimensions. Within the chamber 74, there is mounted a motor 76, which connects to a gear box 78. A power source 80 for driving the motor 76 is provided. Also within the chamber 74, there is located a motor switch 82, which, in response to signals sent through an associated transmitter device (not shown) is able to activate the motor 76.

A jack screw 84 extends from the gear box 78, and a carrier pin 86 is mounted on the jack screw 84. It will be clear that, upon rotation of the jack screw 84 when the motor 76 is switched on, the carrier pin 86 will move or reciprocate along the jack screw 84 in a direction generally indicated by the arrow 88. As will be described below, the carrier pin 86 connects to the slat interface 72, and the appropriate movement of the carrier pin 86 along the jack screw 84 will thus cause the slat interface 72 to move the slats 16 by pivoting them about pins 48 on each of the side edges 38 and 40, to place the slats (in unison) in the selected position so that a desired orientation of the slats 16 can be accomplished according to the user's requirements.

External to the housing 70, the automated shutter control 14 includes a signal receiver 90, which is connected by a wire 92 to the motor switch 82. As described above, a remote transmitter unit is able to transmit a signal to the signal receiver 90, and this signal is in turn conveyed through the wire 92 to the motor switch 82. In response thereto, the motor 76 will be activated, the gear box 78 will cause the jack screw 84 to turn, and the carrier pin 86 will move so as to engage the slat interface 72, as will be described, for opening and closing the slats 16.

The carrier pin 86 includes a body 96, and an engagement pin 98 extending therefrom. The body 96 includes a bore 100 having an internal thread, and this internal thread engages with the external thread 102 on the outer surface of the jack screw 84.

Figure 7:
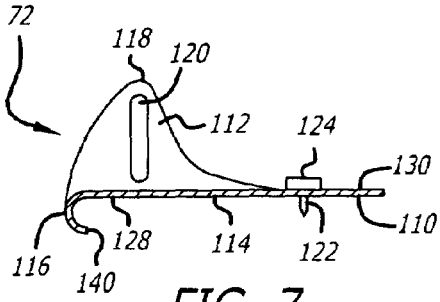
FIG. 7 is a side view of the slat interface component of the automated shutter control of the invention.
Figure 8:
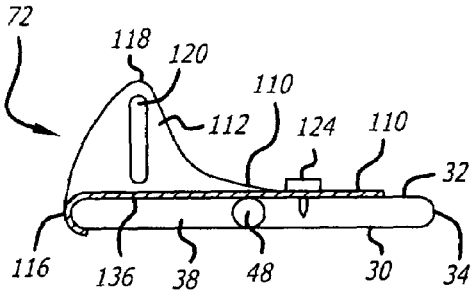
FIG. 8 is a side view of the slat interface shown in FIG. 7, when attached to a slat of a shutter.

Reference is now made to FIGS. 7 and 8 of the drawings, both of which show a slat interface 72 configured in accordance with one embodiment of the invention. FIG. 7 shows the slat interface 72 standing alone, while FIG. 8 shows the same slat interface 72 when connected to a slat 16.

The slat interface 72 comprises a connector portion 110 and a body portion 112. The connector portion 110 comprises a planar component 114 and a curved component 116. In the embodiment of the invention, the body portion 112 is generally triangular in shape, ending in an apex 118, and includes an elongate slot 120. In the slat interface 72 illustrated in FIG. 7, the elongate slot 120 is generally normal or perpendicular to the planar component 114, but it will be appreciated that the overall construction and relationship of the slat interface 72 with the carrier pin 86 may require an elongate slot 120 in a different orientation so as to best accomplish the purposes of the automated shutter control 14 in moving the slats 16.

The planar component 114 includes a hole 122, and a screw 124 fits through the hole 122.

In FIG. 8, the slat interface 72 shown in FIG. 7 is illustrated when attached to a slat 16. The slat 16 has the inside surface 30, outside surface 32, top end 34 and bottom end 36. The side edge 38 is shown with the centrally located pin 48, about which the slat 16 rotates when the shutter is moved between the open and closed position.

The connector portion 110, illustrated standing alone in FIG. 7, has an inner surface 128 and an outer surface 130. In use, the inner surface 128 of the connector portion 110 abuts against the outer surface 32, bottom end 36 and a small distance along the inside surface 30 of the slat 16. The degree of curvature of the curved component 116 is designed so as to correspond with the curve on the bottom end 36 of the slat, so that a snug and firm engagement can be accomplished. In one embodiment, the curved end 116 can be bent or manipulated to take on the shape of the slat 16 to which it will attach.

In a preferred embodiment of the invention, a double-sided glue strip 136 is positioned between the connector portion 110 and the slat 16. Depending upon the strength of the glue strip, as well as the shape and configuration of the connector portion 110, the glue strip may be sufficient to establish a firm connection between the slat interface 72 and the slat 16. To provide additional strength to the connection between the slat interface 72 and the slat 16, the screw 124 can be inserted through the hole 122, and turned so as to engage to a certain depth within the slat 16. This provides a fast and secure connection.

It will be appreciated that the slat interface 72 shown in FIGS. 7 and 8 of the drawings is a representative example only. The invention is not limited to the particular configuration illustrated. Thus, for example, the connector portion 110 may comprise a sleeve which surrounds the entire edge of a slat 16, as opposed to merely a portion thereof, as illustrated in FIG. 8. Further, the connector portion 110 may be partial, as is the case with the slat interface 72 shown in FIG. 7, but be of a different shape so as to engage different parts of the slat 16. As another example, the connector portion 110 may be a pair of parallel plates, connected to each other at one end, and which slides over the slat 16 so as to rest on the inside and outside surfaces 30 and 32 respectively. From these examples, it will be appreciated that the invention is not intended to be limiting insofar as the shape and engagement arrangement with the slat 16 in concerned, but a wide variety of such configurations would be possible within the confines of the invention.

However, an important, but not necessarily limiting, aspect of the invention relates to the fact that the slat interface 72 can attach to a slat 16 as a separate integral piece, and without making any modifications to the slat 16 itself.

Figure 9:
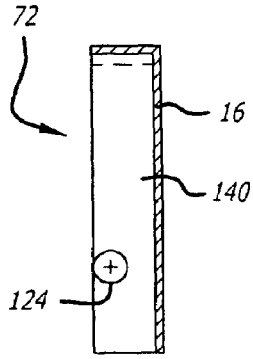
FIG. 9 is a top view of a slat in a shutter, showing a slat interface attached thereto.

With reference to FIG. 9 of the drawings, there is shown a top view of the slat interface 72, when connected to a slat 16, as shown in FIG. 8. The outer surface of the connector portion 110 can be seen, as can be the top of the screw 124, which firmly attaches the slat interface 72 to the slat 16.

Figure 10A:
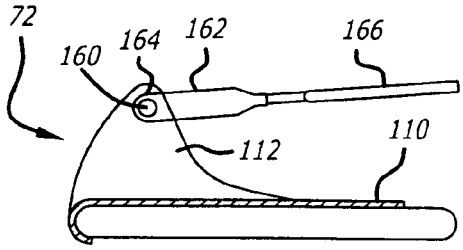
FIGS. 10(*a*) and 10(*b*) are side and top views respectively of another embodiment of the invention which shows a clevis and connecting rod connection between the slat interface and the motor.
Figure 10B:
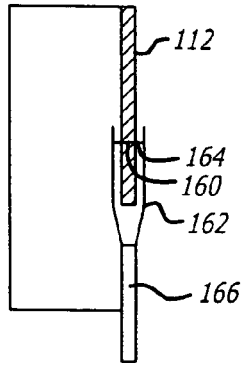

FIGS. 10(*a*) and 10(*b*) are side and top views respectively of another embodiment of the invention which shows a clevis and connecting rod connection between the slat interface and the motor. The slat interface 72 comprises the body portion 112 and connector portion 110. The body portion 112 has an aperture 160 therein and a clevis joint 162 attaches thereto by means of clevis pin 164 passing through the aperture 160. The clevis joint 162 connects to a connecting rod 166 which in turn connects to the motor. Appropriate movement of the connecting rod 166 by the motor will move the slat interface 72 in the desired manner through the connections of the clevis joint 162 and clevis pin 164.

Figure 11A:
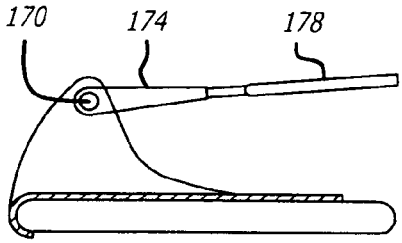
FIGS. 11(*a*) and 11(*b*) are side and top views respectively of an yet another embodiment of the invention which shows a ball joint and connecting rod connection between the slat interface and the motor.
Figure 11B:
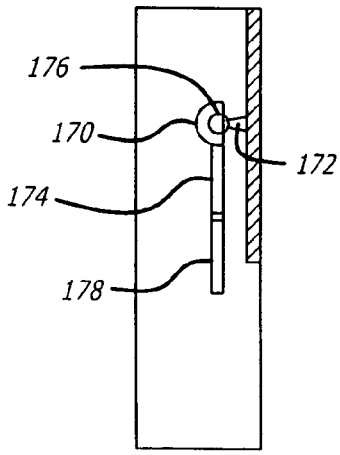

FIGS. 11(*a*) and 11(*b*) are side and top views respectively of yet another embodiment of the invention which shows a ball joint and connecting rod connection between the slat interface and the motor. The slat interface 72 comprises the body portion 112 and connector portion 110. The body portion 112 has a ball 170 mounted on a shaft 172 thereon and a ball joint 174 attaches thereto by means of socket 176 which receives the ball 170. The ball joint 174 connects to a connecting rod 178 which in turn connects to the motor. Appropriate movement of the connecting rod 178 by the motor will move the slat interface 72 in the desired manner through the connections of the ball joint 174 and the ball 170.

Other types of connections are possible within the scope of the invention. Thus, any suitable connection which has the desired action may be used. This may include connections which comprise telescoping arms and connections, reciprocating arms and connections, cam type connectors and the like.

The depth or width of the connector portion 110 can also vary. FIG. 2 shows a slat interface 72 with a connector portion 110 having a width generally indicated by the arrow 140. It will be seen that the width of the connector portion 110 extends for a relatively short distance over a slat 16. The width of the connector portion 110, and the amount by which it covers the slat 16, is thus a variable which can be adjusted from one situation to another. Parameters which will affect this width of course relate to the size of the shutter assembly 12, since larger shutter assemblies will require a greater area of connection. Also determining the width will be the number of slat interfaces 72 used on a specific shutter assembly 12. If only one slat interface 72 is used, a greater width may be required. However, if two or more slat interfaces 72 are used, as shown in FIG. 4, to be discussed, less width is required.

Figure 3:
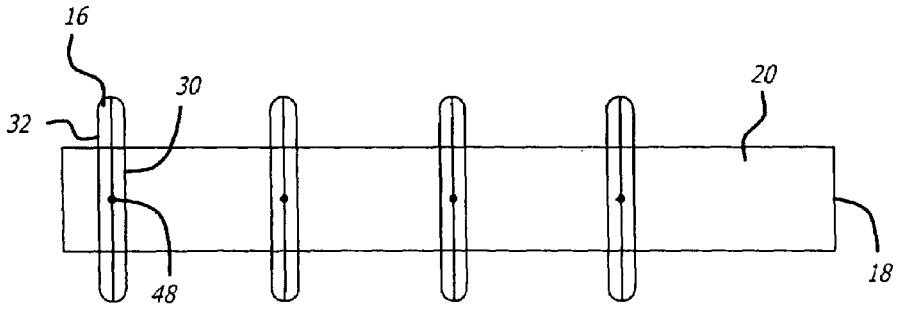
FIG. 3 is a side view of a plurality of slats in a partial shutter frame.

FIG. 3 of the drawings shows a side view of a shutter 12 including a plurality of slats 16 which are shown in the open position. The long side 20 of the frame 18 is partially shown. Each slat 16 has a pin 48, an inside surface 30 and an outside surface 32. Normally, all of the slats 16 in a shutter assembly 12 are connected to each other by a shaft 60 as shown in FIG. 1. Movement of the shaft 60 will shift the orientation of all of the slats 16. For this reason, the movement of any one slat 16 when pivoted about its pin 48 will move all of the other slats 16 in the shutter assembly 12 correspondingly, since the slat 16 being moved will also move the shaft 60, which will in turn move the remaining slats 16. Therefore, the automated shutter control 14 of the invention requires only that it be connected to move one, perhaps two, slats 16, since movement of these slats 16 alone will be transmitted to all remaining slats through the shaft 60.

Figure 4:
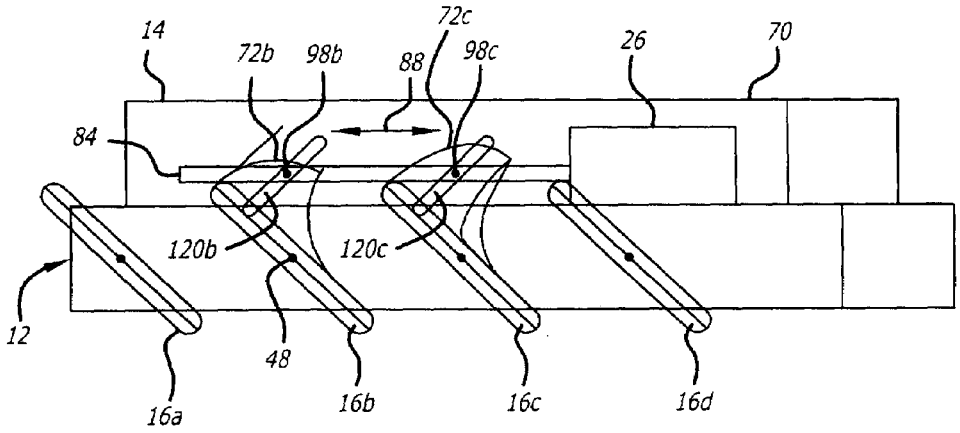
FIG. 4 is a side view of the automated shutter control of the invention, attached to the slats of a shutter.

With reference to FIG. 4 of the drawings, there is shown a schematic illustration of an automatic shutter control 14 of the invention mounted and attached to slats 16 of a shutter assembly 12. In FIG. 4, it will be seen that the slats 16 are in an intermediate orientation or plane, as compared with FIG. 3 where they are substantially horizontal. FIG. 4 shows four slats, 16*a*, 16*b*, 16*c* and 16*d*. Slat interfaces 72*b* and 72*c* are connected to each of the slats 16*b* and 16*c* respectively. These slat interfaces 72*b* and 72*c* are releasably connected to the carrier pin 86, as will be described, making them easy to work with in mounting over the edge of each of the slats 16*b* and 16*c*.

Since two slat interfaces 72*b* and 72*c* are provided in the embodiment shown in FIG. 4, two carrier pins 86, having respective engagement pins 98*b* and 98*c* will be mounted on the jack screw 84, and arranged at an appropriate distance along the jack crew 84 corresponding to the distance between the two slats 16*b* and 16*c*. The housing 70 will be mounted on the frame 18 of the shutter assembly 12 such that the engagement pins 98*b* and 98*c* will register with the elongate slots 120*b* and 120*c* respectively. Alternatively, the housing 70 can first be mounted, and the slats 16 upon which the slat interfaces 72 will be mounted then chosen according to the position of the jack screw.

In operation, the motor 76, when actuated, will cause rotation of the jack screw 84. As the carrier pin 86 moves up and down the rotating jack screw 84, the engagement pins 98*b* and 98*c* will slide along within the elongate slots 120*b* and 120*c*. As will be clearly apparent from FIG. 4 of the drawings, the angle of the elongate slots 120*b* and 120*c* relative to the direction of movement 88 of the carrier pin 86 will move the slat interface 72, and hence the slat 16, so as to rotate the slat 16 about the pin 48. As such, the opening and closing movement of the shutter assembly 12 will be accomplished by varying the orientation of the slats 16.

It will be seen that the automated shutter control 14 is, for the most part, hidden behind the frame 18 so as to be invisible from the inside of the structure. As shown in FIG. 1 of the drawings, the slat interface 72 covers only a small portion of a single slat 16, and for larger shutter assemblies 12 may cover only a small portion of two or three slats. The shape of the connector portion 110 shown in FIG. 7 of the drawings is such that only the very end 140 of the slat interface 72 can be seen when the shutter 12 is closed. Of course, when the slats 16 open, more of the slat interface 72 will become viewable on the outside surface 32 of the slat 16. Even so, however, the body portion 112 and connector portion 110 can be of relatively small dimensions, and can also be discreetly colored and shaped, so as not to attract any undue attention and compromise the aesthetic features of the shutter 12.

In FIG. 1, it will also be seen that the signal receiver 90 is mounted on the inside-facing surface of the frame. The wire 92 may run on the outside surface of the frame, and a small hole through which the wire passes from the outside to the inside is provided. The signal receiver 90 is preferably small and discreet so that it will not be easily noticeable. However, the signal receiver 90, although it can be placed in other positions, as may be appropriate, should be accessible to transmitted signals from a remote control, so that it can receive the signals in order to activate the motor switch 82 and turn the motor 76 to effect opening and closing. The remote control may have different buttons for opening and closing respectively, and the signal receiver 90 would be able to transmit appropriate and different signals to the motor switch 82 so as to carry out the instructions of the user based on button pressed on the remote control.

In one embodiment, the signal receiver 90 may be integrated into the shutter "pull" or handle, preferably in the form of a small electric eye embedded therein.

As shown particularly in FIGS. 5 and 6 of the drawings, the automated shutter control 14 of the invention includes a solar cell or panel 144. The solar cell 144 is a relatively flat, elongate structure, and is mounted on the housing 70 on a side thereof which faces the outside, so that it is able to be charged by solar energy. The solar cell/panel 144 would be in electrical contact with the power source 80, so that solar energy collected during daylight hours can be transmitted and stored in the power source 80 for use when needed. It will thus be appreciated that the power source 80 may include rechargeable batteries, rechargeable by solar energy where a solar panel 144 is used. The solar power source 18 may alternatively, or in addition, comprise batteries installed so as to provide a backup source of energy in case the solar charged power source should be insufficient or run out.

The presence of the solar panel obviously has several advantages. The most notable advantage is the fact that it is never necessary to change batteries in the power source 80, since sunlight provides an ongoing, consistent form of energy for use by the automated solar collector 14. It is also advantageous to have the solar panel 144 and/or batteries, so that it is unnecessary to hook up the automated shutter control 14 of the invention with any electric outlet source within the house or office. In this way, the expense of providing electrical outlets at every window, as well as the possible unsightly wires which may be necessary to support this, can be avoided.

Preferably, and in accordance with one embodiment on the invention, the motor may be controlled by a motion control board with an infrared interface. As an example only, the entire unit of the invention may be powered by approximately 600 mA battery, preferably charged by a solar panel. The hand-held control unit would preferably be an infrared (IR) transmitter, similar to those which control many home electronic devices including television sets, DVD payers, stereo systems and the like. This offers the user the convenience of opening and closing the shutter from any remote location in the room, so that, especially when a passage to the shutters may be obscured or obstructed by furniture, easy operation thereof is maintained.

In another embodiment of the invention, the engagement pin 98 may not travel along a jack screw 84. Rather, the engagement pin 98 may move along a stationary gear rack. Alternatively, the pin may be mounted in a gear rack which itself is caused to move by a rotary gear thus moving the engagement pin 98 with it which will in turn rotate the slat interface.

In one preferred embodiment, the body portion 112 may be comprised of reinforced nylon, other durable plastic, or metal such as steel or aluminum. It is preferably anchored to the slat by the curved part, so that proper engagement is secured. The double-sided tape, and a small-width screw enhance the connection.

A clutch or other mechanism may be incorporated into the invention to protect the shutters, other components and users in case a jam or obstruction is encountered in the opening or closing of the shutters. This may be a mechanism which allows the jack screw, carriage, connecting arm of any type etc. to slip or yield if the shutters encounter an obstruction. In certain embodiments, this may result in a ratcheting action and sound which would alert the user to the fact that an obstruction is present and needs to be removed. This clutch or other mechanism may assume a variety of configurations and operates as both a safety and protective component.

The invention is not limited to the precise details described and illustrated herein.

The invention claimed is:

1. An automated shutter control for a shutter having a plurality of slats each with a pair of opposing end side edges and upper and lower external surfaces therebetween and which are pivoted in unison, the automated shutter control comprising:

a motor;

a slat interface having a body portion and a connector portion depending therefrom, the connector portion having a contour that overlies and connects to at least one of the upper and lower external surfaces only of at least one of the slats of the shutter when so connected; and a moving assembly moved by the motor and connectable to the body portion so as to move the slat interface between a first and a second position.

2. An automated shutter control as claimed in claim 1 wherein the moving assembly is connectable to the body portion of the slat interface.

3. An automated shutter control as claimed in claim 1 wherein the body portion includes an elongate slot arid the moving assembly includes an engagement pin, the engagement pin being received within the elongate slot.

4. An automated shutter control as claimed in claim 1 wherein the moving assembly comprises a screw threaded shaft connected to the motor and rotated about its axis by the motor, and a carriage assembly threadedly mounted on a jack screw so that rotation of the jack screw moves the carriage assembly in a reciprocating linear manner along the jack screw, the direction of movement of the carriage assembly being determined by the direction of rotation of the jack screw.

5. An automated shutter control as claimed in claim 4 wherein the carriage assembly comprises a carriage body having a threaded passage therein for mounting on the jack screw, and an engagement pin extending from the carriage body, the engagement pin being connectable to the slat interface.

6. An automated shutter control as claimed in claim 5 wherein the body portion of the slat interface includes an elongate slot in which the engagement pin is received.

7. An automated shutter control as claimed in claim 1 wherein the connector portion comprises a flat plate portion connectable to a flat surface of the slat, and a curved portion corresponding in shape to a curve on the slat, the flat plate portion and curved portion together at least partially engaging the slat.

8. An automated shutter control as claimed in claim 7 further comprising a second flat plate portion connected to the curved portion to engage a second surface of the slat.

9. An automated shutter control as claimed in claim 1 wherein the connector portion comprises a sleeve dimensioned and configured to engage an end of one of the slats.

10. An automated shutter control as claimed in claim 1 further comprising adhesive means on the connector portion, the adhesive means providing adhesion to a slat when the slat interface is connected to a slat.

11. An automated shutter control as claimed in claim 10 wherein the adhesive means comprises a double-sided tape.

12. An automated shutter control as claimed in claim 10 wherein the adhesive comprises glue.

13. An automated shutter control as claimed in claim 1 wherein the body portion of the slat interface comprises a projection extending upwardly from the connector portion, the projection including receiving means for engagement with the moving assembly.

14. An automated shutter control as claimed in claim 1 further comprising a gear box between the motor and the moving assembly.

15. An automated shutter control as claimed in claim 1 further comprising a power source for the motor.

16. An automated shutter control as claimed in claim 15 wherein the power source comprises a solar energy collector and a solar energy storage device.

17. An automated shutter control as claimed in claim 16, further comprising a housing for the motor and at least a part of the moving assembly, the solar collector being mounted on the outside of the housing for exposure to sunlight.

18. An automated shutter control as claimed in claim 15 wherein the power source is a battery.

19. An automated shutter control as claimed in claim 15 wherein the power source is an AC supply outlet.

20. An automated shutter control as claimed in claim 1 further comprising a remote activation system for activating the motor from a distance.

21. An automated shutter control as claimed in claim 20 wherein the remote activation system comprises a signal receiver associated with the automated shutter control, a switch member for activating the motor in response to a signal received from the receiver, and a remote transmitter for transmitting a signal to the signal receiver to activate the motor.

22. An automated shutter control as claimed in claim 21 wherein the remote transmitter has at least two input buttons to effect movement of the slat interface to either the first or the second position respectively.

23. An automated shutter control as claimed in claim 1 wherein the connector portion incorporates a hole, and a screw which passes through the hole to fasten the connector portion to a slat.

24. An automated shutter control as claimed in claim 1 wherein the body portion includes an aperture and the moving assembly includes a clevis joint, the clevis joint being received by the aperture.

25. An automated shutter control as claimed in claim 1 wherein the body portion includes a ball and the moving assembly includes a socket, the socket being received by the ball.

26. An automated shutter control as claimed in claim 1 further comprising a slip mechanism to prevent further movement of the shutters when an obstruction is present.

27. A shutter and automated shutter control combination comprising:

a shutter having a plurality of parallel slats each with a pair of opposing end side edges and upper and lower external surfaces therebetween and which are pivoted in unison;

an automated shutter control adjacent the plurality of slats, the automated shutter control comprising a housing, a motor within the housing, a slat interface having a body portion and a connector portion depending therefrom, the connector portion having a contour that overlies and connects to at least one of the upper and lower external surfaces only of at least one of the slats of the shutter when so connected, and a moving assembly partially in the housing and partially extending outside of the housing to releasably connect to the body portion so as to move the slat interface between a first and a second position.

28. A shutter and automated shutter control combination as claimed in claim 27 wherein the automated shutter control comprises at least two slat interfaces, each of which is connected to a different slat on the shutter, at least two slat interfaces being moved in unison by the moving assembly.

29. An automated shutter control for a shutter having a plurality of slats each with a pair of opposing end side edges and upper and lower external surfaces therebetween and which are pivoted in unison, the automated shutter control comprising:

a motor;

a slat interface dimensioned to register with and engage at least a portion of one of the upper and lower external surfaces only of at least one of the slats of the shutter when so engaged; and a moving assembly, moved by the motor and connectable to the slat interface so as to move the slat interface between a first and a second position.

30. A method for opening and closing a shutter having a plurality of slats each with an upper and lower external surface between a pair of opposing end side edges, the method comprising:

attaching a slat interface contoured to register with and engage at least one of the upper and lower external surfaces only of at least one of the slats of the shutter when so engaged;

locating a moving assembly adjacent the slat interface so as to engage therewith, the moving assembly not being directly connected to the slats; and reciprocating the moving assembly so that the slat interface moves between a first and a second position corresponding to the open and closed position of the shutter.

31. A method as claimed in claim 30 further comprising attaching a solar collector to a shutter control, and locating a power source within the shutter control which is charged by energy derived from the solar panels.

32. A method as claimed in claim 30 further comprising the step of locating a remote activation system on the automated shutter control so that a remote transmitted signal is received by a signal receiver on the automated shutter control, the signal receiver activating the motor to move the slat interface between the first and the second position.

* * * * *